US006444910B1

(12) United States Patent
Goto

(10) Patent No.: US 6,444,910 B1
(45) Date of Patent: Sep. 3, 2002

(54) STRUCTURE AND METHOD FOR CONNECTING A FLAT CABLE TO BUS BARS

(75) Inventor: Hideki Goto, Mie (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 70 days.

(21) Appl. No.: 09/593,419

(22) Filed: Jun. 14, 2000

(30) Foreign Application Priority Data

Jun. 16, 1999 (JP) ..... 11-170196
Jun. 17, 1999 (JP) ..... 11-170874
Jun. 18, 1999 (JP) ..... 11-172496

(51) Int. Cl.[7] ..... H01B 7/08

(52) U.S. Cl. ..... 174/70 B; 174/71 B; 174/72 TR; 174/117 F

(58) Field of Search ..... 174/70 B, 88 R, 174/117 F, 117 R, 71 B, 72 B, 84 C, 72 TR

(56) References Cited

U.S. PATENT DOCUMENTS 5,824,955 A * 10/1998 Saiso et al. ..... 174/88 R
5,962,813 A 10/1999 Shirako et al. ..... 174/88 R

FOREIGN PATENT DOCUMENTS

JP 3059971 3/1991
JP 07245130 9/1995

OTHER PUBLICATIONS

English Language Abstract of JP 07245130.

* cited by examiner

*Primary Examiner*—Chau N. Nguyen
*Assistant Examiner*—W. David Walkenhorst
(74) *Attorney, Agent, or Firm*—Greenblum & Bernstein, P.L.C.

(57) ABSTRACT

There is provided a structure for connecting a flat cable to bus bars. To this end, conductor strips are first exposed from the end portion of the flat cable. The inventive structure includes bus bars and conductor strips adhered to the bus bars, thereby forming a joint section including strip layers and strip gaps. The structure includes a first and a second insulator resin sheet respectively placed on a first and a second face of the joint section. At least the first insulator resin sheet is then configured such that it penetrates into the strip gaps and adheres to the second insulator resin sheet, so as to form insulating grooves. In this manner, narrow conductor strips of a flat cable and corresponding bus bars can be connected with sufficient mechanical strength, and their insulation is improved.

20 Claims, 15 Drawing Sheets

STRUCTURE AND METHOD FOR CONNECTING A FLAT CABLE TO BUS BARS

BACKGROUND OF THE INVENTION

1. Field of the Invention

The present invention relates to a structure and method for connecting a flat electrical cable to bus bars. More particularly, the invention concerns a connection between relaying bus bars, and a flat cable used for steering equipment in automobiles. In automobiles, a flat cable is contained in a cable reel. The flat cable is then connected to lead cables joined to external circuits, through the relaying bus bars.

2. Description of Background Information

FIGS. 1 and 2 show a ring-shaped cable enclosure including a fixed element 1 joined to a steering shaft. The cable enclosure further includes a mobile element 2 connected to a steering wheel in a freely rotatable way around the fixed element 1. A flat cable 3 is then stored in the cable enclosure in a helically wound condition. The flat cable 3 has a given length and each of its two ends is connected to an edge of a relay bus bar 5 attached to inner cases. The latter are respectively joined to the fixed element 1 and the mobile element 2. The other edge of the relay bus bar 5 is connected to lead cables 6 leading to external circuits. The flat cable is wound or unwound in unison with the rotation of the mobile element 2.

As shown in FIG. 2, when connecting the flat cable 3 to the relay bus bar 5, a plurality of relay bus bars 5 having a narrow width are fitted into grooves aligned in the inner case 4, and insert-molded with the latter. An end portion of the flat cable 3 is stripped of its resin coating, so that aligned conductor strips 3*a* are exposed. These conductor strips 3*a* are superposed on the plurality of relay buys bars 5, and are bonded by ultrasonic welding. A lid 7 us then put on the inner case 4, such that the joint section is protected.

As the number of circuits increases, the widths of the conductor strips 3*a* of flat cable 3 are reduced, as are the setting-up pitches of the conductor strips 3*a*. Consequently, the connection between the conductor strips 3*a* and the relay bus bars 5 are mechanically weakened, to the extent that the joint section can no longer be protected solely by the inner case 5 and the lid 7. Further, the ribs formed by the neighboring grooves of inner case 4, which isolate the conductor strip layers from each other, are also rendered smaller and narrower, so that the circuits can no longer be insulated sufficiently from one another.

As described above, when the relay bus bars 5 are insert-molded into the inner case 4, the relay bus bars 5 are made smaller. Their mechanical strength is thus reduced. Accordingly, the relay bus bars 5 are easily broken during insert-molding. Moreover, their fixing positions in the inner case 4 become more prone to variations.

Further, manufacture of dies for insert-molding relay bus bars 5 with an inner case 4, and for a protective lid 7, incurs high costs.

SUMMARY OF THE INVENTION

In view of the above, a primary object of the present invention is to provide a joint section between a flat cable and bus bars which is securely protected and insulated, and to reduce production costs.

To this end, there is provided a structure for connecting a flat cable to bus bars, the flat cable exposing conductor strips. The structure includes bus bars and conductor strips adhered onto the bus bars, thereby forming a joint section including strip layers and strip gaps. The structure further includes a first and second insulator resin sheet placed respectively on a first and a second face of the joint section. In this structure, at least the first insulator resin sheet is configured such that it penetrates into the strip gaps and adheres onto the second insulator resin sheet, so as to form insulating grooves.

Preferably, at least the first insulator resin sheet is a thermoplastic insulator resin sheet. Further, the conductor strips may be adhered onto the bus bars by welding. Suitably, the strip layers includes at least one of the configurations chosen from the groups consisting of punched holes, embossed figures and rivet cramping.

The structure may further include a holder and a lid made of an insulator resin and enclosing the joint section including the first and the second insulator resin sheet.

There is further provided a method of connecting a flat cable to bus bars including preparing bus bars in the form of strips, stripping off a coating from an end portion of a flat cable, whereby conductor strips are exposed, and adhering the conductor strips onto the bus bars by welding, thereby forming a joint section having a first face and a second face, and including strip layers and strip gaps. The method also includes covering the first face with a thermoplastic insulator resin sheet, while covering the second face with an insulator resin sheet, respectively, providing a device including a pressing plane with alternating concave and convex configurations, and heating the device and pressing the pressing plane onto the thermoplastic insulator resin sheet, whereby the thermoplastic insulator resin sheet adheres to the strip layers by virtue of the concave configurations, while it adheres to the insulator resin sheet in the strip gaps by virtue of the convex configurations, thereby forming insulating grooves.

Alternatively, there is provided a method of connecting a flat cable to bus bars including preparing an insulator resin sheet, arranging bus bars in the form of strips on the insulator resin sheet, stripping off a coating from an end portion of a flat cable, whereby conductor strips are exposed, and adhering the conductive strips onto the bus bars by welding, thereby forming a joint section having a first face and a second face, and including strip layers and strip gaps. The method also includes covering the first face with a thermoplastic insulator resin sheet, while covering the second face with an insulator resin sheet, respectively, providing a device including a pressing plane with alternating concave and convex configurations, and heating the device and pressing the pressing plane onto the thermoplastic insulator resin sheet, whereby the thermoplastic insulator resin sheet adheres to the strip layers by virtue of the concave configurations, while it adheres to the insulator resin sheet in the strip gaps by virtue of the convex configuration, thereby forming insulating grooves.

Alternatively yet, there is provided a method of connecting a flat cable a bus bars including preparing bus bars in the form of strips, stripping off a coating from an end portion of a flat cable, whereby conductor strips are exposed, and adhering the conductor strips onto the bus bars by welding, thereby forming a joint section having a first face and a second face, and including strip layers and strip gaps. The method also includes covering the first face and the second face with a thermoplastic insulator resin sheet, respectively, providing a first device and a second device, respectively, including a pressing plane with alternating concave and convex configurations, and heating the first and second devices and pressing the pressing plane onto the first and second faces, respectively, whereby the thermoplastic insulator resin sheets adhere to the strip layers by virtue of the concave configurations, while they adhere to each other in the strip gaps by virtue of the convex configurations, thereby forming insulating grooves.

The above methods may further include enclosing the joint section covered with the thermoplastic insulator resin sheet and/or the insulator resin sheet, with a holder and a lid.

Suitably, the insulator resin sheet is made of polyethylene terephthalate, and has a thickness of about 70 $\mu$m.

As described above, a joint section (including welded strip layers), that includes bus bars and conductor strips aligned in parallel, is arranged on an insulator resin sheet (base plate). Another insulator resin sheet is then placed on the joint section and spread thereon. As the welded bus bars and conductor strips are covered with an insulator resin sheet from both sides thereof, the welded strip layers are mechanically reinforced by the insulator resin sheet, and protection of these strips is greatly improved. Further, both lateral faces of each of the welded strip layers are likewise covered with the insulator resin sheet. Furthermore, the insulator resin sheet (conductor strip side) is also adhered to the portions of the base plate placed between the welded strip layers, thereby forming an insulating section. The insulating section improves the insolation between the circuits. Accordingly, it is no longer needed to insert-mold the bus bars in an inner case, or to manufacture a molded cover, as done in the past. Production costs can thus be greatly reduced.

According to the above invention, one face of the insulator resin sheet which is put into contact with the joint section is preferably coated with an adhesive.

In a first connecting method, the bus bars are not loaded on the base plate at the outset. Instead, the conductor strips of a flat cable are first superposed on the bus bars. Thereafter, they are bonded by ultrasonic welding or a similar means, and then placed on the base plate (one of the insulator resin sheets). In this method, both ends of the aligned bus bars may be joined beforehand by a respective carrier band. In this condition, the conductor strips are superposed on the bus bars and welded. After welding, the carriers are cut off, to free the circuits.

In a second connecting method, the bus bars are first placed on the base plate. The conductor strips of a flat cable are then superposed on the bus bars. Subsequently, the bus bars and the conductor strips are bonded by ultrasonic welding or a similar means. In this method, the base plate may be provided with small holes arranged at a given interval. The bus bars and the conductor elements are then arranged on the small holes, and welding is performed.

In both methods, the conductor strips, welded on the bus bars, are covered with a thermoplastic insulator resin sheet after the welding.

As mentioned above, the joint section is covered with an insulator resin sheet from both faces thereof. The sheets are then adhered by heated devices, so that not only the conductor strips and the bus bars are firmly bonded, but also the joint section itself is better protected from outside.

The insulator resin sheets may be sized up appropriately, depending on the number of the bus bars and conductor strips used. An increase in the number of circuits can thus be easily met.

Further, adhesion of the insulator resin sheets can be conducted easily by using first and second devices. It is therefore no longer necessary to use a costly resistance welding machine or ultrasonic welding machine. As mentioned above, the devices respectively include a pressing plane with alternating concave and convex configurations. The convex configurations press the insulator resin sheets into the strip gaps formed between the strip layers. The sheets thus inserted between the strip gaps prevent interactions between the conductor strips.

After a first fixing operation is effected by the above devices, a second fixing operation may be performed by piecing, embossing or rivet cramping the insulator resin sheets. Such a second fixing operation strengthens further the adhesion between the conductor elements and the bus bars which had already been adhered firmly by the insulator resin sheets. For example, when the conductor strips and the bus bars are punched from above the resin sheets, there occur returns inside the pierced holes. These returns hold the bus bars and the conductor strips together and solidify the adhesion. Likewise, when the resin sheets are embossed, the conductor strips and the bus bars are undulated, so that they are held together more firmly.

Further, the conductor element and the bus bars may be pierced, and clamped by rivets through the pierced holes. Besides the above mentioned fixing methods, laser welding can also be applied.

BRIEF DESCRIPTION OF THE DRAWINGS

The above and the other objects, feature and advantages of the present invention will be made apparent from the following description of the preferred embodiments, given as non-limiting examples, with reference to the accompanying drawings, in which.

DETAILED DESCRIPTION OF THE PREFERRED EMBODIMENTS

Figure 1:
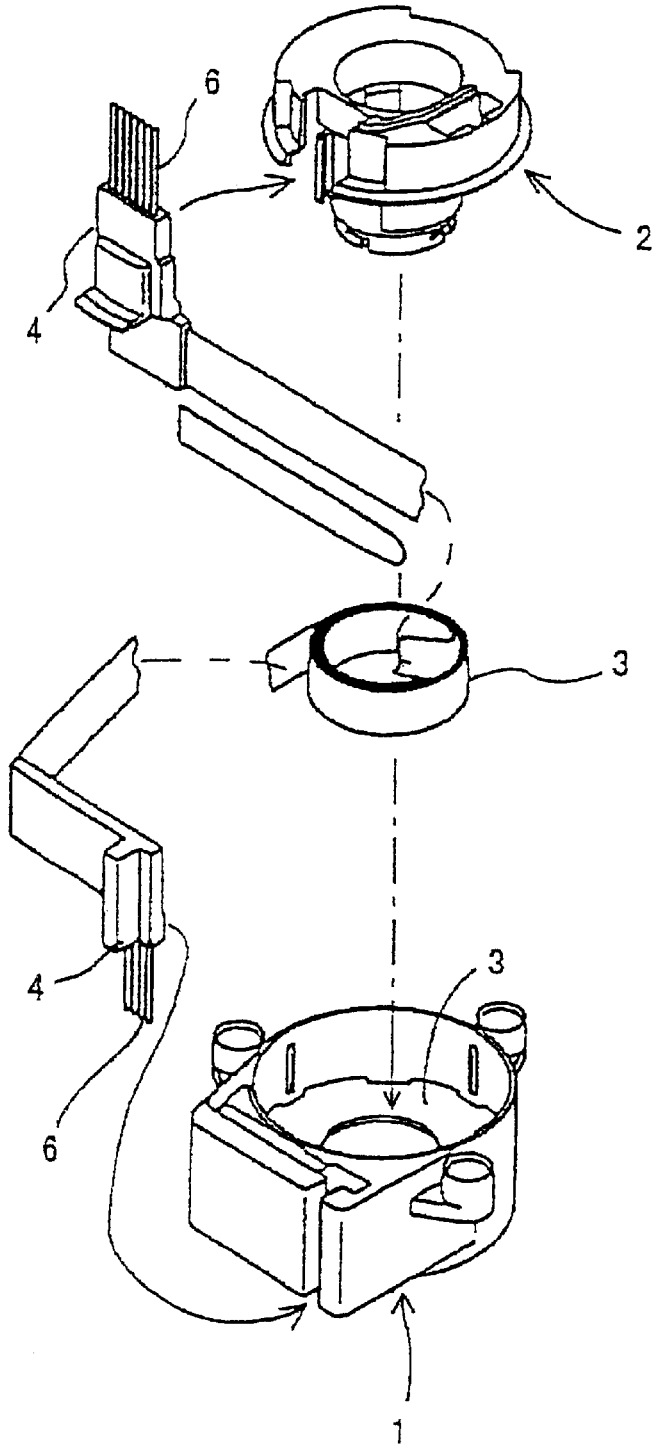
FIG. 1 PRIOR ART
FIG. 1 is an exploded perspective view of a prior art cable reel.
Figure 2:
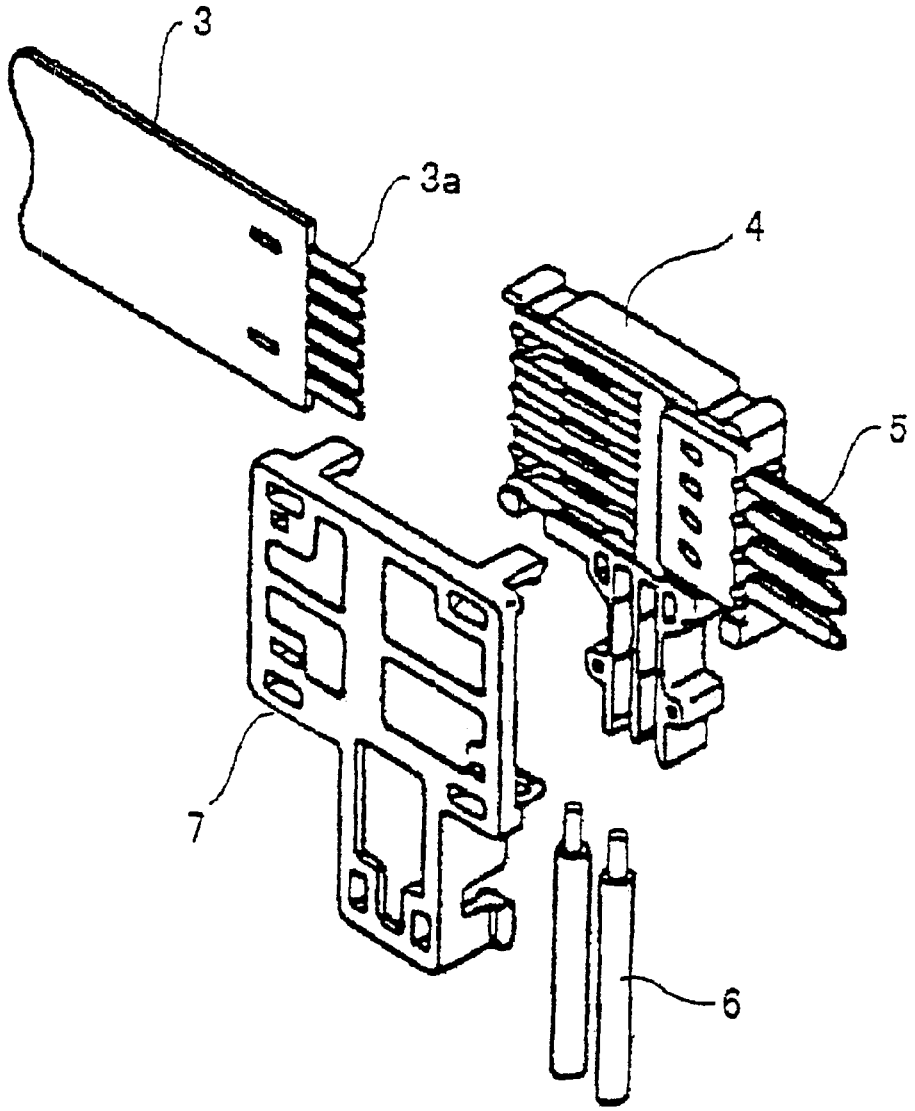
FIG. 2 PRIOR ART
FIG. 2 is an exploded perspective view of a joint section between a flat cable and bus bars known in the prior art.
Figure 3A:
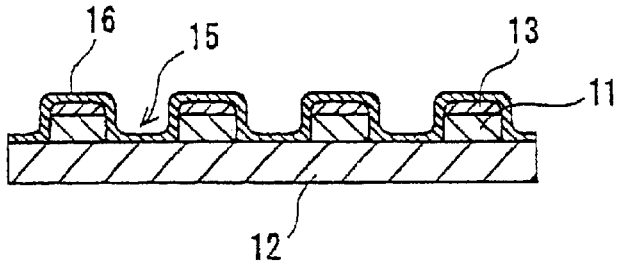
FIG. 3A is a cross-sectional view of a joint section between a flat cable and the bus bars according to the invention.
Figure 3B:
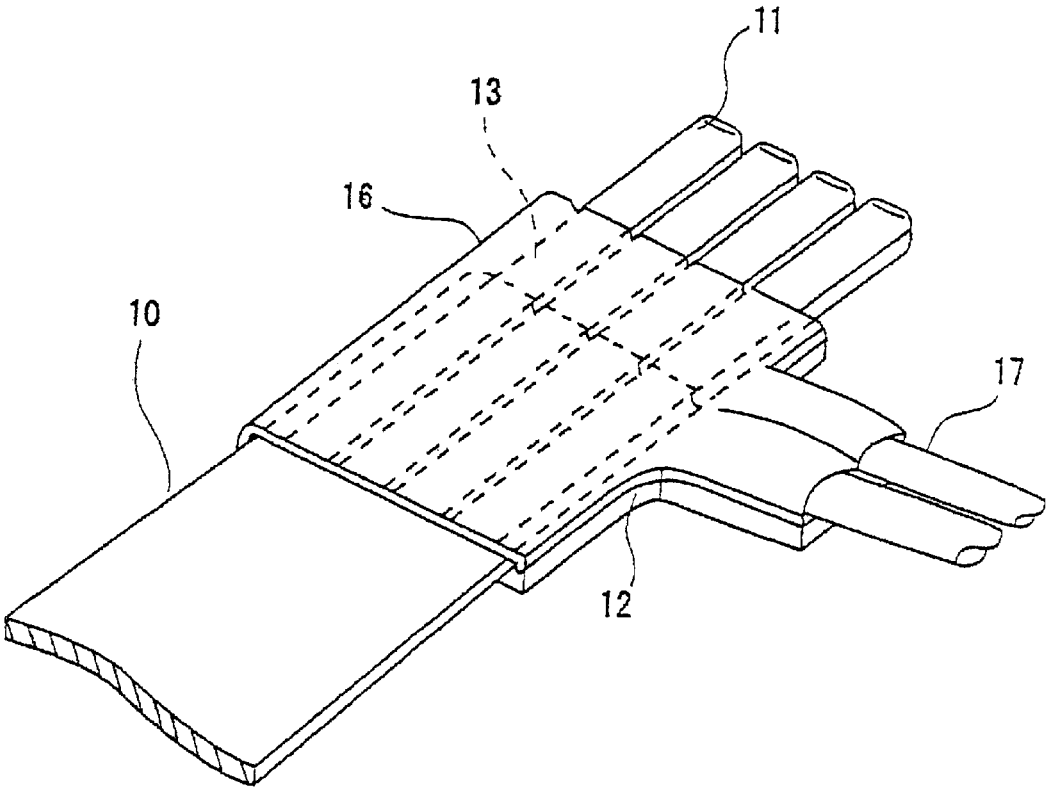
FIG. 3B is a perspective view of the joint section of FIG. 3A.

FIGS. 3A and 3B show a first aspect of the connecting structures of the invention, in which there is provided a joint section between conductor strips of a flat cable 10 (contained in the cable reel of FIG. 1), and bus bars 11 for relaying (hereafter referred to as bus bars). In this structure, a plurality of narrow bus bars 11 are aligned in parallel on a base plate 12 made of a suitable insulator resin (insulator resin sheet). In parallel, the corresponding number of conductor strips 13 are exposed from an end portion of the flat cable 10. These conductor strips 13 are superposed on the corresponding bus bars 11, and bonded in any suitable manner, for example, by ultrasonic welding, thereby forming strip layers. The base plate 12 has a flat surface wherever the bus bars 11 are placed. The strip layers including the bus bars 11 and the conductor strips 13 are aligned at a given pitch, thereby forming strip gaps 15 between the strip layers.

The entire surface of the joint section X (FIG. 4B) including the strip layers and the strip gaps is then laminated with an insulator resin sheet 16 made of any suitable material, for example, polyethylene terephthalate having a suitable thickness, for example, of about 70 $\mu$m. Consequently, the strip layers (including the conductor elements 13 and the bus bars 11) are covered from above with the insulator resin sheet 16. Likewise, the strip gaps 15 are also covered with the insulator resin sheet 16, such that the sheet 16 is laminated onto the base plate 12 along the strip gaps.

The base plate 12 may then be locked to a fixed and a mobile element of a cable reel. The other end of the bus bars 11 can be connected to lead cables 17 linking to external circuits.

In the above structure, the joint section X is prepared according to the method illustrated in FIGS. 4A to 4E.

Figure 4A:
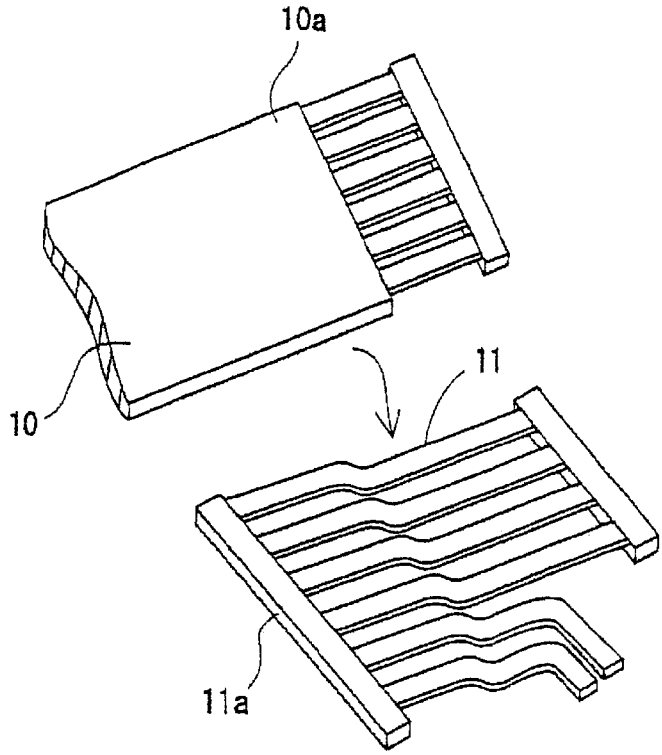
FIGS. 4A to 4E are views illustrating a first method of the invention showing how the joint section is formed.
Figure 4B:
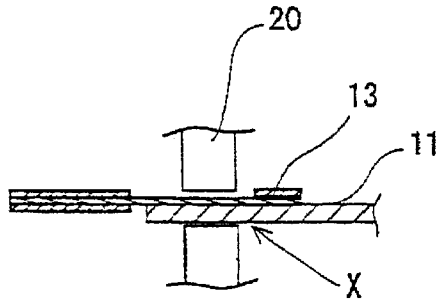

As shown in FIG. 4A, a plurality of bus bars 11 include two end portions, each of which is joined in any suitable manner, for example, by welding through a respective carrier band 11*a*. The conductor strips 13 in the flat cable 10 are then exposed by stripping off an insulator film 10*a*. These conductor strips 13 are superposed on one end portion of the bus bars 11. As shown in FIG. 4B, the superposed bus bars 11 and conductor strips 13 are bonded in any suitable manner, for example, by an ultrasonic welding machine 20, so as to form strip layers between the bus bars 11 and the corresponding conductor strips 13. After welding, the carrier bands 11*a* are cut off the bus bars 11 so as to free the latter.

Figure 4C:
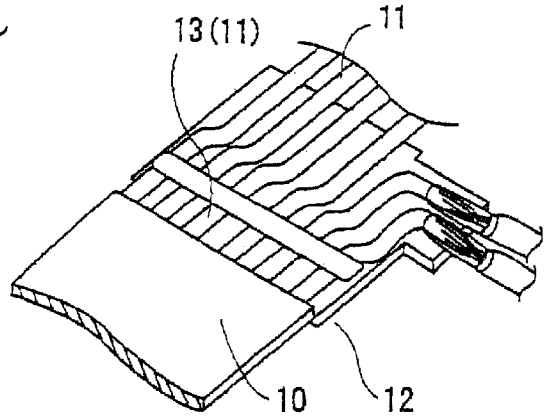
Figure 4D:
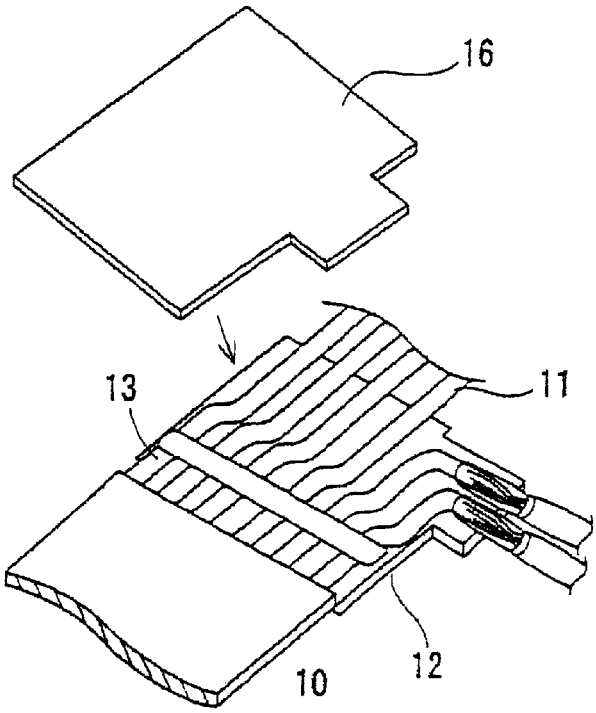

As shown in FIG. 4C, the bus bars 11 are placed on the base plate 12, so that the strip layers are positioned near one end portion of the base plate 12. As shown in FIG. 4D, a thermoplastic insulator resin sheet 16 has a size adapted to cover the entire surface of the joint section X. This sheet 16 is then placed on the joint section X including the strip layers and the strip gaps. One face of the sheet 16 may be coated with an adhesive, so as to adhere to the joint section X more firmly.

Figure 4E:
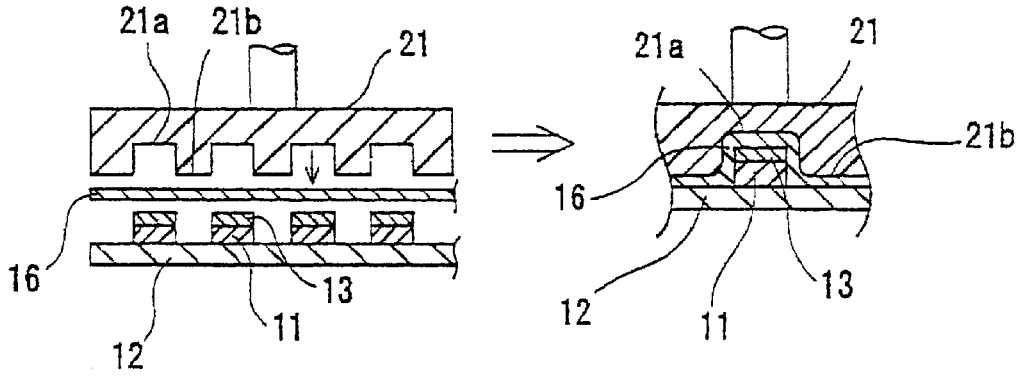

Further, as shown in FIG. 4E, there is provided a device 21 including a pressing plane with alternating (or sequential) concave and convex configurations 21*a* and 21*b*. The device 21 is made of a metal having necessary hardness and heat conductivity. Alternating intervals between the concave configurations 21*a* and the convex configurations 21*b* correspond to the pitches between the strip layers formed by the conductor elements 13 and the bus bars 11. The device 21 is heated and pressed onto the thermoplastic insulator resin sheet 16. In this manner, the strip layers including the bus bars 11 and the conductor strips 13 are laminated with the insulator resin sheet 16 by virtue of the concave configurations 21a, while the base plate 12 is directly covered with the sheet 16 in the strip gaps 15, by virtue of the convex configurations. The above operation thus provides the structure shown in FIGS. 3A and 3B.

Figure 5A:
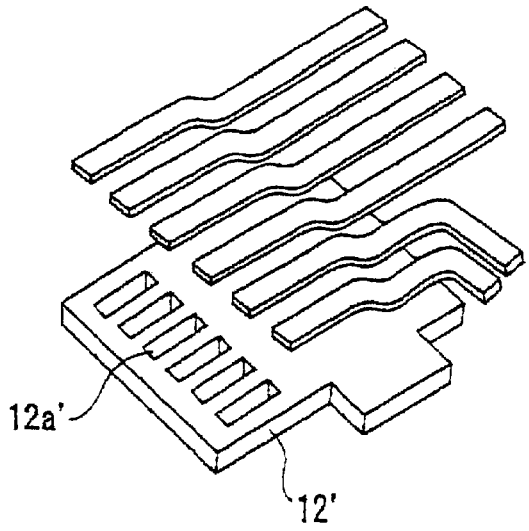
FIGS. 5A to 5E are views illustrating a second method of the invention showing how the joint section is formed.

FIGS. 5A to 5E show a second connecting method. By contrast with the first method, bus bars 11 are placed on a base plate 12', before the conductor strips 13 in a flat cable 10 are welded to the bus bars 11 (FIG. 5A). For positioning, the bus bars 11 may be provided with pin holes, into which engage pins projecting from the base plate 12' (not shown). The base plate 12' includes holes 12*a*' in positions located under the bus bars 11 of the strip layers. These holes 12*a*' allow the conducting of the ultrasonic welding operation.

Figure 5B:
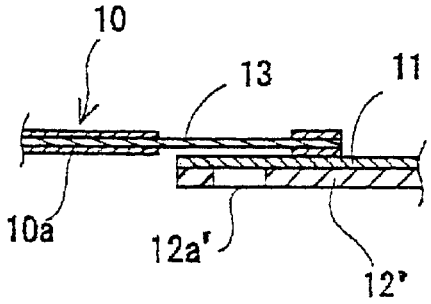
Figure 5C:
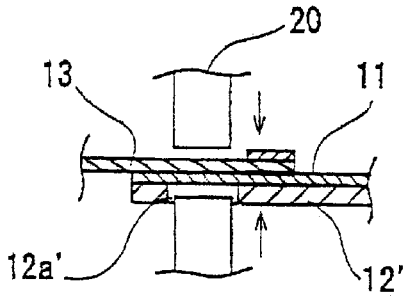
Figure 5D:
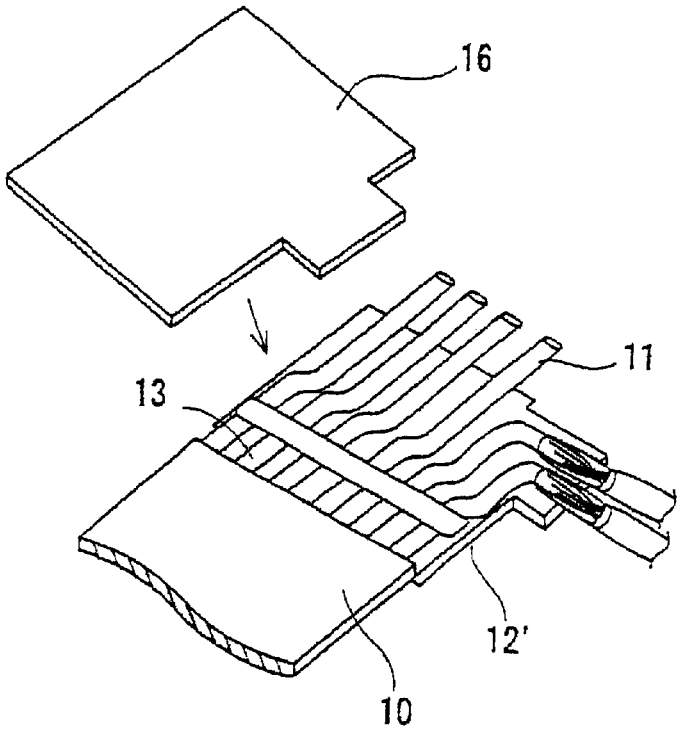

As shown in FIG. 5B, the conductor strips 13 exposed at the end portion of the flat cable 10 are superposed on the bus bars 11. In FIG. 5C, the conductor strips 13 and the bus bars 11 are bonded by an ultrasonic welding machine 20, to yield strip layers. Thereafter, in FIG. 5D, an insulator resin sheet 16 is placed on the joint section X as in the case of the first method.

Figure 5E:
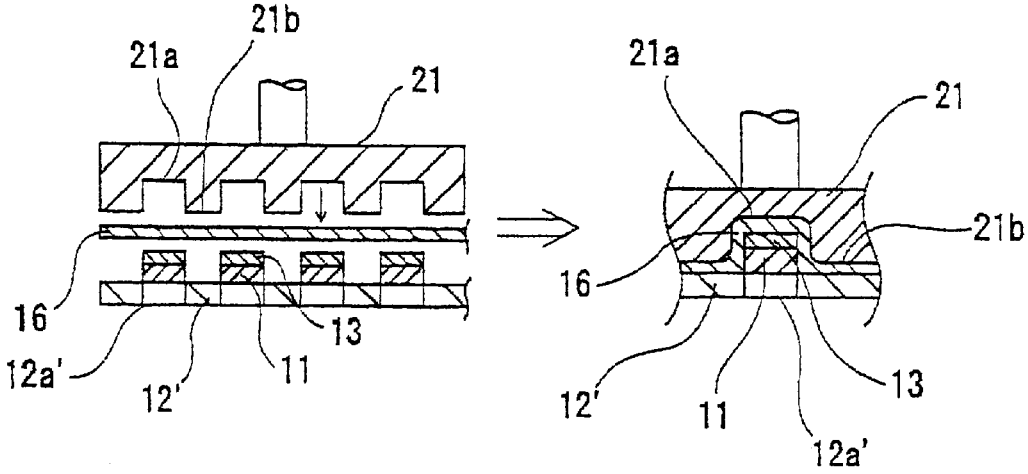

As shown in FIG. 5E, the insulator resin sheet 16 is then pressed by device 21, to produce a structure shown in FIGS. 3A and 3B.

Figure 6A:
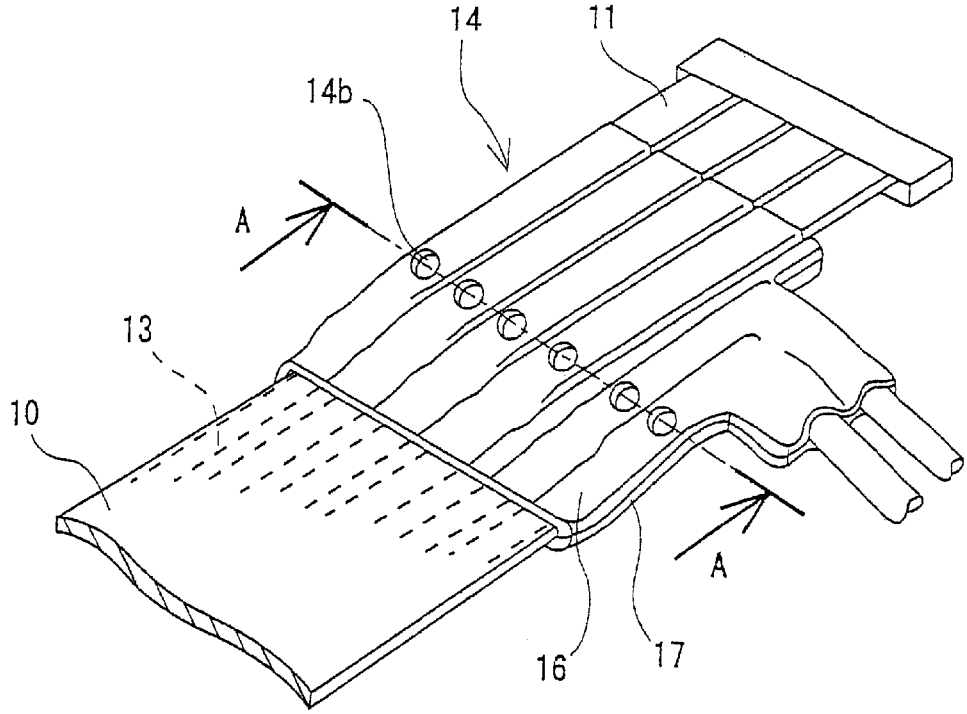
FIG. 6A is perspective view of a structure connecting a flat cable to bus bars according to a first aspect of the invention.
Figure 6B:
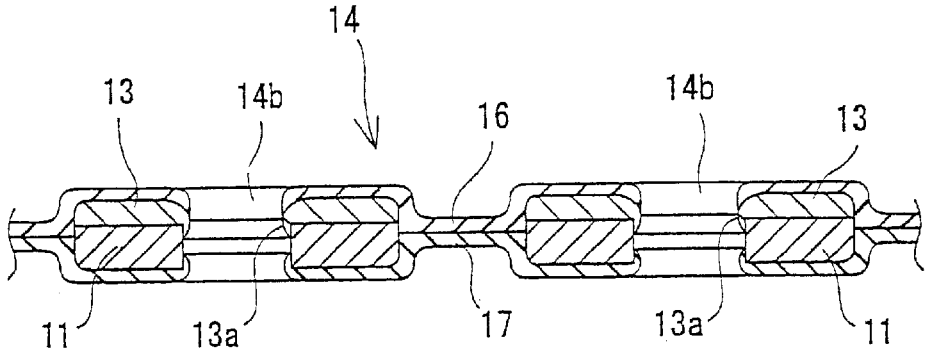
FIG. 6B is a cross-sectional view along line A—A in the connecting structure of FIG. 6A.

FIGS. 6A and 6B show a second aspect of the connecting structures of the invention. In this structure, exposed conductor elements 13 are superposed on aligned bus bars 11, forming the joint section. Insulator resin sheets 16 and 17 are then adhered on the joint section from opposite sides thereof. Thereafter, holes 14*b* are formed by piercing all the layers.

Figure 7A:
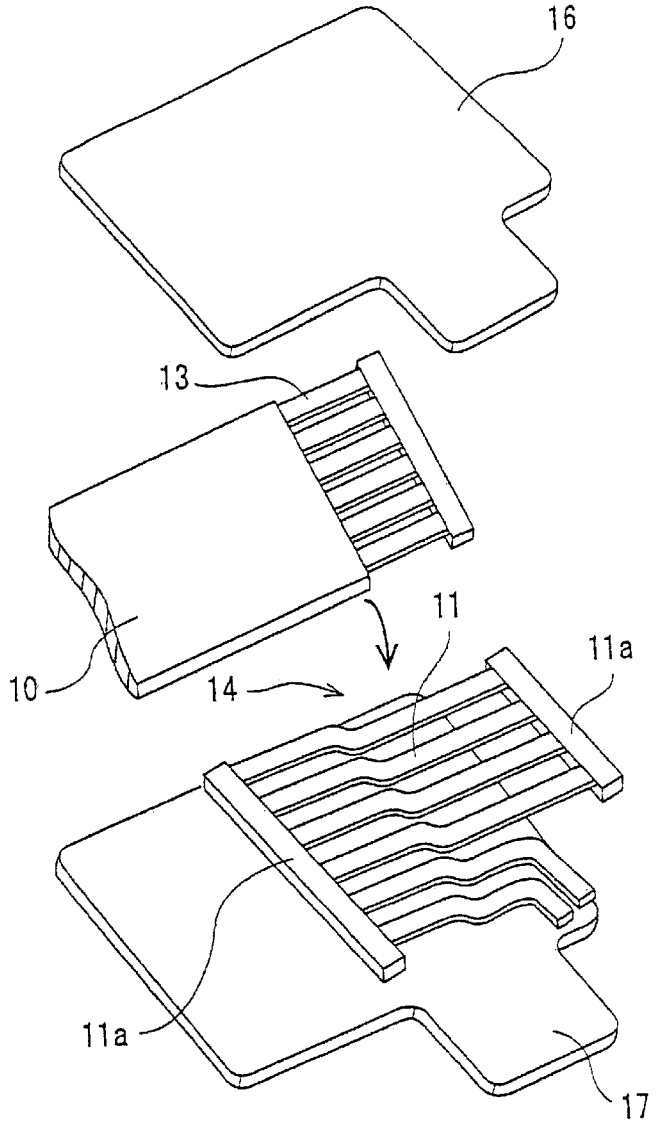
FIGS. 7A to 7C are perspective views illustrating how a first fixing operation proceeds in a connecting structure according to a second aspect of the invention.
Figure 7B:
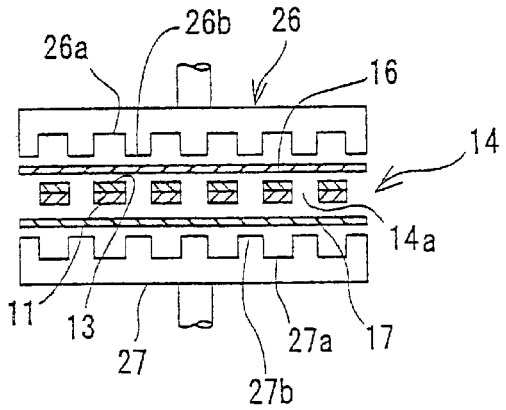
Figure 7C:
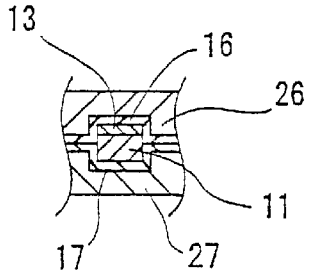

The structure for connecting the conductor strips to the bus bars of FIGS. 6A and 6B is manufactured according to the method illustrated in FIGS. 7A, 7B and 7C.

The conductor strips 13 and the bus bars 11 are arranged as in the case of the first aspect of the invention. The portions of the bus bars other than those connected to the conductor elements 13 may be formed by insert-molding as before.

The joint section X of the conductor elements 13 and the bus bars 11 are flanked by two insulator resin sheets 16 and 17. These sheets 16 and 18 are formed of any suitable material, preferably thermoplastic sheets. In the present embodiment, a 70 $\mu$m-thick polyethylene terephthalate is used. The latter is cut out to a size covering the entire surface of the joint section X.

The insulator resin sheets 16 and 17 thus arranged are adhered onto the joint section X by a first device 26 and a second device 27. These devices 26 and 27 are of the same nature as that used in the first aspect of the invention. One face of the first device 26 forms a pressing plane having alternating concave and convex configurations 26*a* and 26*b*. The second device 27 likewise comprises alternating concave configurations 27*a* and convex configurations 27*b*.

The first and second devices 26 and 27 are then heated, and pressed onto the first and second insulator resin sheets 16 and 17 from opposite sides toward the surfaces of the joint section 14 (first fixing step). The concave configurations 26*a* and 27*a* thus adhere the conductor strips 13 to the bus bars 11, as shown in FIG. 7C. Further, as the pressing devices are hot, the insulator resin sheets become soft, adapt to the outer figure of the joint section X, and adhere to the lateral faces of the strip layers 14. The convex configurations 26*b* and 27*b* penetrate into the strip gaps 14*a*, where the first and the second insulator resin sheets 16 and 17 adhere to each other. The contact faces of the opposing insulator resin sheets 16 and 17 may be coated with an adhesive.

By virtue of this adhesion, the strip gaps 14*a* surrounding the strip layers 14 of conductor elements 13 and bus bars 11 are covered with the laminates of insulator resin sheets 16 and 17. Accordingly, even if the conductor strips are narrow and lack mechanical resistance, the joint section is reinforced by these resin sheets 16 and 17. Further, as the insulator resin sheets 16 and 17 fill the strip gaps 14*a*, short circuits can be prevented efficiently.

Figure 8:
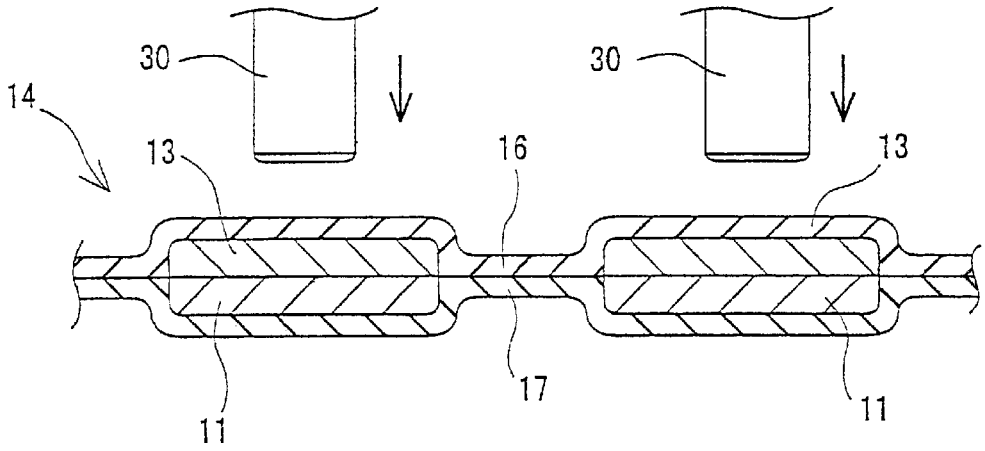
FIG. 8 is a side view showing how punching operations (second fixing operation) are proceeded in a connecting structure, according to a second aspect of the invention.
Figure 9A:
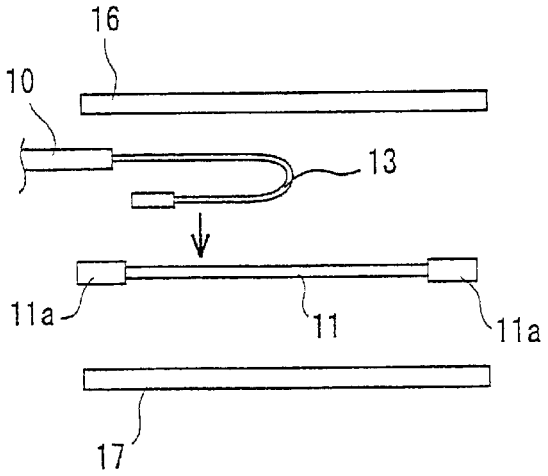
FIGS. 9A and 9B are side views of variant joint sections connecting the conductor strips to the bus bars.
Figure 9B:
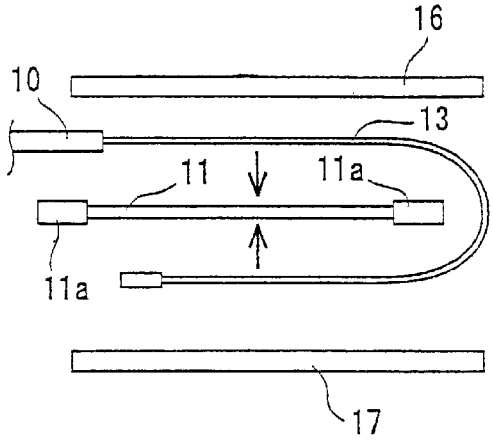
Figure 10A:
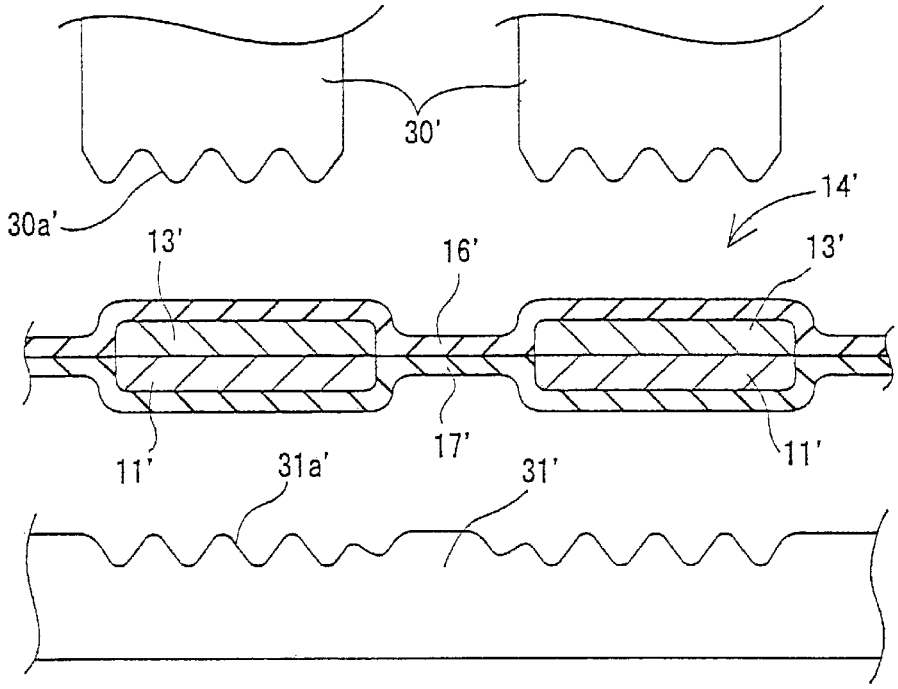
FIGS. 10A and 10B are side views showing how embossing operations (second fixing operation) proceed in a connecting structure according to second aspect of the invention.
Figure 10B:
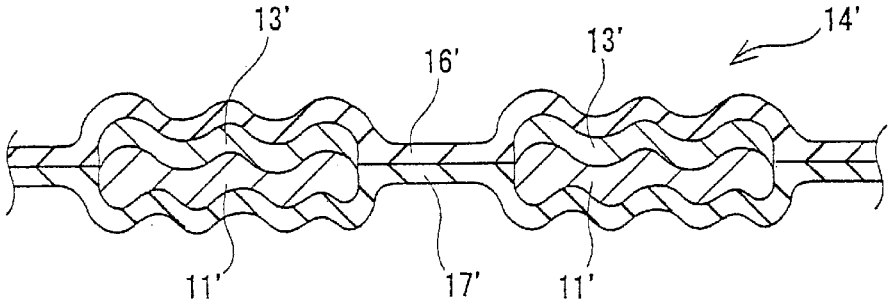

As shown in FIG. 8, the strip layers 14 after the first fixing operation may be punched from above the insulator resin sheets 16 and 17 by a press having a piercing die 30 (second fixing operation).

By punching holes 14*b* in the strip layers 14 as shown in FIG. 6B, the conductor elements 13 and the bus bars 11 are adhered to each other even more firmly. For instance, by punching with the piercing die 30, part of the first insulator resin sheet 16 is drawn into the holes 14*b*, so that the conductor strips 13 become covered with returns 13*a*, and the latter moves towards the bus bars 11. Further, by withdrawing the piercing die 30, part of the second insulator resin sheet 17 is also dragged into the holes 14*b*.

As mentioned above, when the strip layers 14 are subjected to the first fixing operation, the strip layers 14 are first protected by the laminated insulator resin sheets. Then, through the second fixing operation, the pierced surface of the strip layers 14' from both sides thereof. After the strip layers 14' are embossed, the conductor strips 13' and the bus bars 11' are undulated by plastic transformation, and are firmly adhered to each other.

Figure 11A:
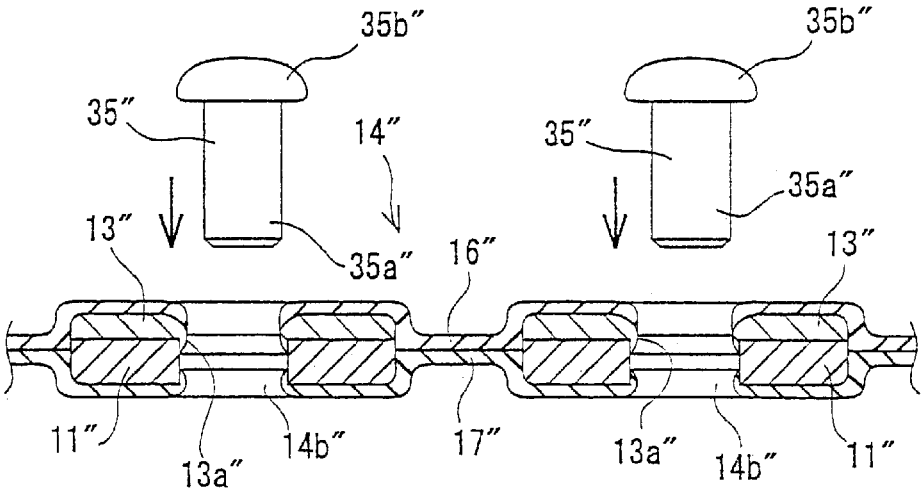
FIGS. 11A and 11B are side views showing how rivet operations (second fixing operation) proceed in a connecting structure according to a second aspect of the invention.
Figure 11B:
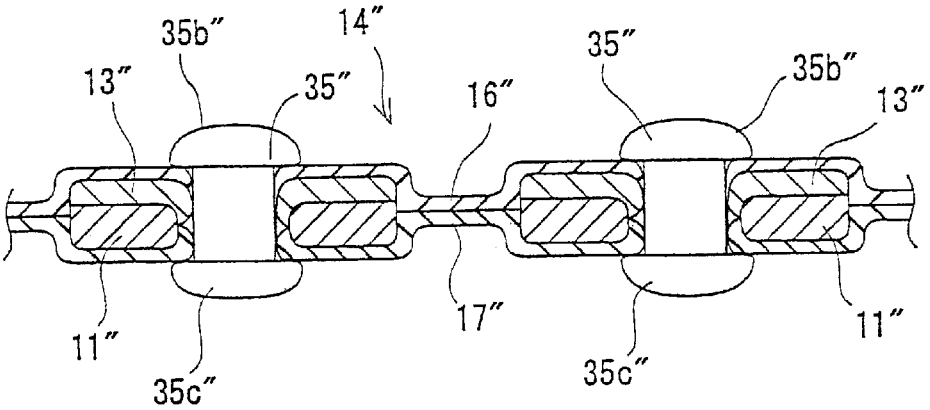

FIGS. 11A and 11B show a structure of strip layers 14" according to a third example, in which conductor elements 13" exposed from a flat cable 10" are bound to bus bars 11". The strip layers 14" are formed at the second fixing operation, to yield holes 14*b*", as in the case of the first example. Rivets 35" are then inserted into the holes 14*b*". Edge portions 35*a*" of the rivets 35" are cramped to form cramping heads 35*c*", so that the conductor strips 13" and the bus bars 11" are fixed even more firmly. The rivets 35" are made of low conductivity materials such as aluminum or brass. Accordingly, although rivet heads 35*b*" emerge from the insulator resin sheets 16" and 17", short circuits through these rivet heads may be prevented.

Figure 12A:
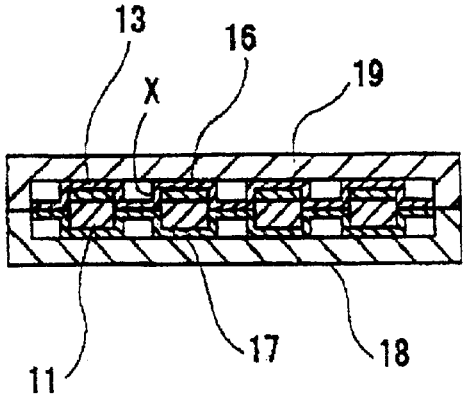
FIG. 12A is a cross-sectional view of a joint section connecting a flat cable to bus bars according to a third aspect of the invention.
Figure 12B:
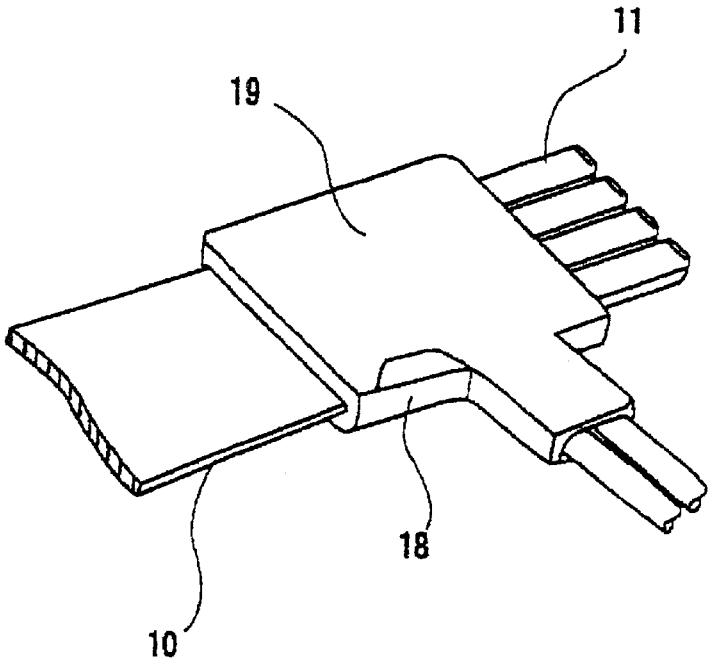
FIG. 12B is a perspective view of the joint section of FIG. 12A.

FIGS. 12A and 12B show a third aspect of the connecting structures of the invention.

After the strip layers including bus bars 11 and conductor strips 13 are covered with resin sheets 16 and 17, the joint section is inserted into a holder 18 made into the form of a box. The holder 18 is joined to a lid 19 through a hinge. The holder 18 and the lid 19 are integrally formed of a resin.

The holder 18 is locked to one of a fixed element and a mobile element of the cable reel. Further, the other end of the bus bars 11 is connected to lead cables 20 leading to external circuits.

In the above structure, connections are made according to the method illustrated in FIGS. 13A to 13E.

Figure 13A:
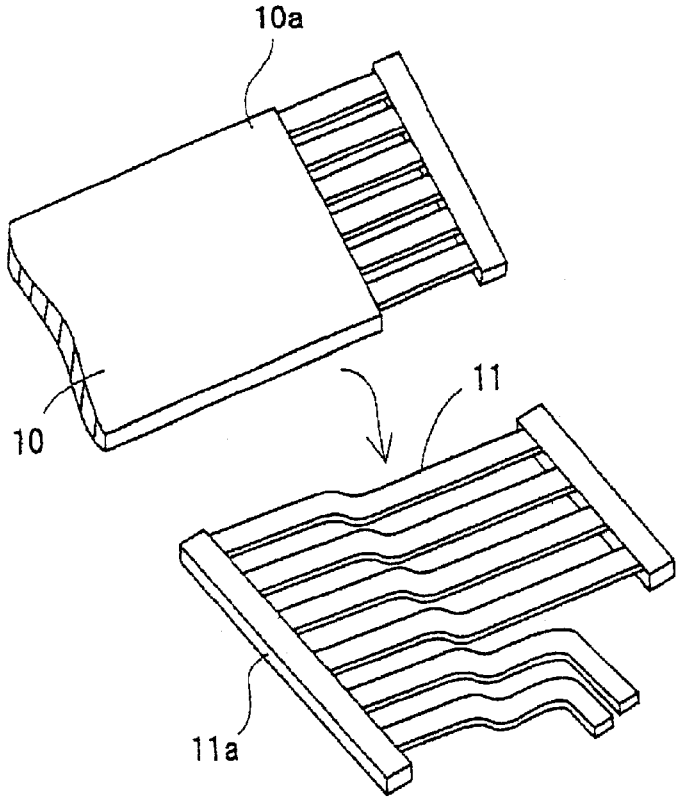
FIGS. 13A to 13E are views illustrating a third method of the invention showing how the joint section is formed.
Figure 13B:
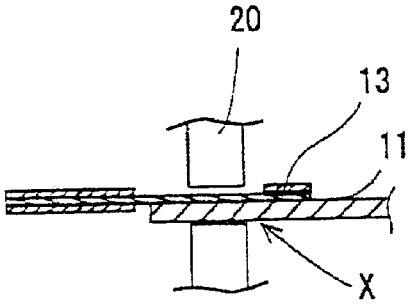

As shown in FIG. 13A, a plurality of bus bars 11 have two end portions which are joined by carrier bands 11 a by welding. The conductor strips 13 of flat cable 10 are then exposed by stripping off an insulator film 10*a*. These conductor strips 13 are superposed on one end portion of the bus bars 11. As shown in FIG. 13B, the superposed bus bars 11 and conductor strips 13 are bonded by an ultrasonic welding machine 20, so as to form strip layers 14 including the bus bars 11 and the corresponding conductor elements 13. After welding, the carrier band 11*a* is cut off the bus bars 11 so as to free the latter.

Figure 13C:
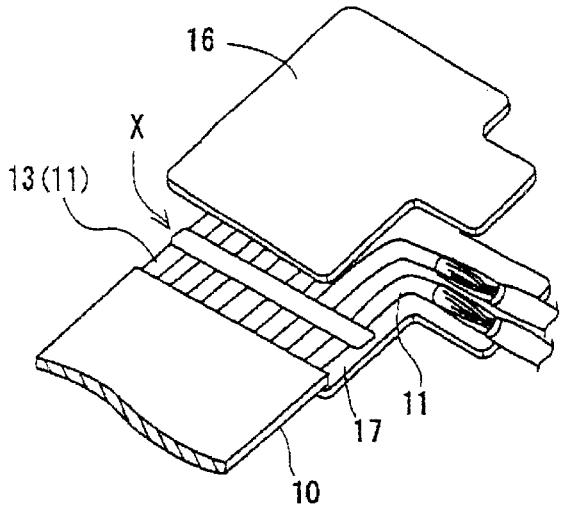

As shown in FIG. 13C, the strip layers 14 are flanked by the respective thermoplastic insulator resin sheets 16 and 17 from both sides of the strip layers 14. The faces of the resin sheets that contact with the strip layers 14 are preliminarily coated with an adhesive.

Figure 13D:
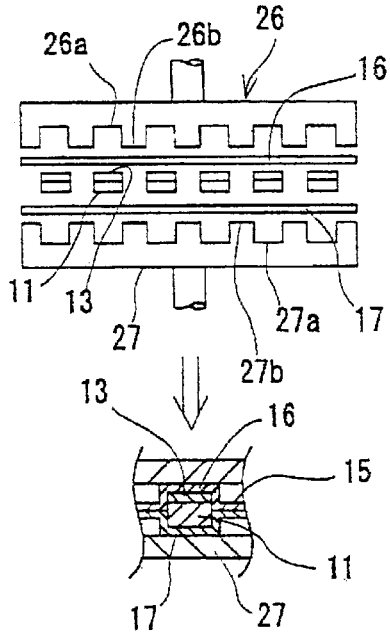

As shown in FIG. 13D, there is provided a first device 26 and a second device 27 as in the foregoing embodiments. The devices 26 and 28 are heated and pushed onto the respective thermoplastic insulator resin sheets 16 and 17. In this manner, the strip layers including the bus bars 11 and conductor elements 13 are coated with the insulator resin sheets 16 and 17 by virtue of the concave configurations 26*a* and 27*a*, while the sheets 16 and 17 are adhered to each other in the strip gaps 14*a* by the convex configurations 26*b* and 27*b*, so as to form insulating strips 15.

Figure 13E:
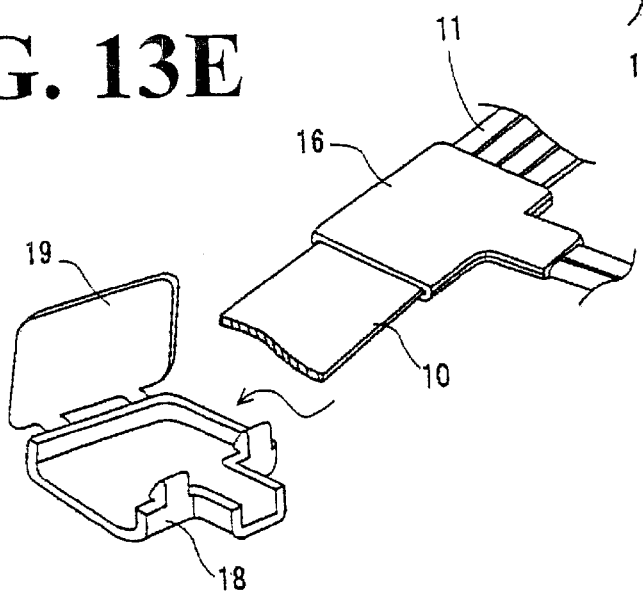

As shown in FIG. 13E, the joint section, including the laminated bus bars 11 and conductor strips 13, is inserted into the holder 18 and covered with a lid 19. The holder 18 and the lid 19 are then closed by locking.

When the width of the conductor elements 13 and the bus bars 11 is narrow, the resistance of the joint section may not be sufficient. Even in such a case, the two-side laminates of the resin sheets 16 and 18, and the holder 18 and lid 19 combine to secure the protection of the joint section.

As is apparent from the foregoing description, the two faces of the joint section including bus bars and conductor elements are completely laminated with the insulator resin sheet, so that protection of the strip layers is secured, and the insulation is improved. Moreover, the joint section is contained in the holder and lid combination, so that protection of the joint section is complete.

As is apparent from the foregoing description, the invention may employ an insulator resin sheet as a base plate, instead of an inner case in which bus bars are to be insert-molded. Moreover, the hitherto-used inner case included a lid having a complex configuration. Such a complicated construction can now be replaced by a base plate which is prepared very easily. Production costs are thus reduced drastically. Further, there is no longer a need to use a lid, and the joint section including bus bars and conductor strips can be miniaturized. Such a structure requires less space, which provides important advantage when stored in a cable reel.

Likewise, as the strip layers including bus bars and conductor elements are completely covered with the insulator resin sheet, protection of the strip layers is better secured compared to the known covered inner case.

As the conductor strips in a flat cable tend to become narrower with higher pitches, the corresponding bus bars must also be narrower. As a result, the strip layers becomes less resistant. Even in such a case, the strip layers can be strengthened by the laminates of insulator resin sheet, and their insulation is nevertheless enhanced.

The resin sheets are adhered to each other in a hot and flexible state by concave-and-convex configured devices. The insulator resin then penetrates into strip gaps formed between neighboring strip layers, thereby securing insulation between the strip layers.

The insulator resin sheets may be cutoff as desired, as a function of the number of circuits contained in the joint section. An increase or change of the circuit number can thus be responded to very easily. Moreover, to achieve the adhesion between the conductor strips and the bus bars, it is no longer needed to employ costly apparatus, such as a resistance welding machine or an ultrasonic welding machine. Installation costs are thus reduced.

When the adhesion between the conductor strips and the bus bars is to be improved, piercing, embossing, cramping by rivets or laser welding may be performed from above the laminated insulator resin sheet, which strengthen the connecting structure even further.

The bus bars sometimes includes whiskers or barbs. Even in such a case, the insulator resin street laminated thereon can prevent spurious contacts between the neighboring bus bars. Further, the opposing lateral faces of the strip layers, as well as the base plate in the strip gaps, are covered with the insulator resin sheet. Accordingly, even when the strips layers are aligned at a close pitch, there occurs no short circuit between the neighboring strip layers. A good insulation can thus be secured.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application Nos. HEI 11-170196, HE 11-170874, and HEI 11-172496, respectively filed on Jun. 16, 1999, Jun. 17, 1999, and Jun. 18, 1999, respectively, which are all herein expressly incorporated by reference in their entireties.

In the claims:

1. A structure for connecting a flat cable to bus bars, the flat cable having exposed conductor strips, said structure comprising:

said conductor strips adhered to said bus bars, thereby forming a joint section including strip layers and strip gaps;

a first and second insulator resin sheet respectively placed on a first and a second face of said joint section;

at least said first insulator resin sheet being configured such that it penetrates into said strip gaps and adheres onto said second insulator resin sheet to form insulating grooves.

2. The structure affording to claim 1, wherein at least said first insulator resin sheet is a thermoplastic insulator resin sheet.

3. The structure according to claim 2, wherein said conductor strips are adhered to said bus bars by welding.

4. The structure according to claim 3, wherein said strip layers include at least one of punched holes, embossed figures and rivet cramping.

5. The structure according to claim 4, further comprising a holder and a lid formed of an insulator resin, and enclosing said joint section including said first and said second insulator resin sheet.

6. The structure according to claim 2, wherein said strip layers include at least one of punched holes, embossed figures and rivet cramping.

7. The structure according to claim 6, further comprising a holder and a lid formed of an insulator resin, and enclosing said joint section including said first and said second insulator resin sheet.

8. The structure according to claim 2, further comprising a holder and a lid formed of an insulator resin, and enclosing said joint section including said first and said second insulator resin sheet.

9. The structure according to claim 1, wherein said conductor strips are adhered to said bus bars by welding.

10. The structure according to claim 9, wherein said strip layers include at least one of punched holes, embossed figures and rivet cramping.

11. The structure according to claim 9, further comprising a holder and a lid formed of an insulator resin, and enclosing said joint section including said first and said second insulator resin sheet.

12. The structure according to claim 1, wherein said strip layers include at least one of punched holes, embossed figures and rivet cramping.

13. The structure according to claim 12, further comprising a holder and a lid formed of an insulator resin, and enclosing said joint section including said first and said second insulator resin sheet.

14. The structure according to claim 1, further comprising a holder and a lid formed of an insulator resin, and enclosing said joint section including said first and said second insulator resin sheet.

15. A method of connecting a flat cable to bus bars comprising:

preparing bus bars in the form of strips;

stripping off a coating from an end portion of a flat cable, whereby conductor strips are exposed;

adhering said conductor strips onto said bus bars by welding, thereby forming a joint section having a first face and a second face, and including strip layers and strip gaps;

covering said first face with a thermoplastic insulator resin sheet, while covering said second face with an insulator resin sheet, respectively;

providing a device including a pressing plane with alternating concave and convex configurations; and heating said device and pressing said pressing plane onto said thermoplastic insulator resin sheet, whereby said thermoplastic insulator resin sheet adheres on said strip layers by virtue of said concave configurations, while said thermoplastic insulator resin sheet adheres on said insulator resin sheet in said strip gaps by virtue of said convex configurations, thereby forming insulating grooves.

16. The method according to claim 15, further comprising enclosing said joint section, covered with said thermoplastic insulator resin sheet and said insulator resin sheet, with a holder and a lid.

17. A method of connecting a flat cable to bus bars comprising:

preparing an insulator resin sheet;

arranging bus bars in the form of strips on said insulator resin sheet;

stripping off a coating from an end portion of a flat cable, whereby conductor strips are exposed;

adhering said conductor strips onto said bus bars by welding, thereby forming a joint section having a first face and a second face, and including strip layers and strip gaps;

covering said first face with a thermoplastic insulator resin sheet, while covering said second face with an insulator resin sheet, respectively;

providing a device including a pressing plane with alternating concave and convex configurations; and heating said device and pressing said pressing plane onto said thermoplastic insulator resin sheet, whereby said thermoplastic insulator resin sheet adheres to said strip layers by virtue of said concave configurations, while said thermoplastic insulator resin sheet adheres to said insulator resin sheet in said strip gaps by virtue of said convex configurations, thereby forming insulating grooves.

18. The method according to claim 17, further comprising enclosing said joint section, covered with said thermoplastic insulator resin sheet and said insulator resin sheet, with a holder and a lid.

19. A method of connecting a flat cable to bus bars comprising:

preparing bus bars in the form of strips;

stripping off a coating from an end portion of a flat cable; whereby conductor strips are exposed;

adhering said conductor strips onto said bus bars by welding, thereby forming a joint section having a first face and a second face, and including strip layers and strip gaps;

covering said first face and said second face with a thermoplastic insulator resin sheet, respectively;

providing a first device and a second device respectively including a pressing plane with alternating concave and convex configurations; and heating said first and second devices and pressing said pressing plane onto said first and second faces, respectively, whereby said thermoplastic insulator resin sheets adheres on said strip layers by virtue of said concave configurations, while said thermoplastic insulator resin sheets adhere to each other in said strip gaps by virtue of said convex configurations, thereby forming insulating grooves.

20. The method according to claim 19, further comprising enclosing said joint section, covered with said thermoplastic insulator resin sheets, with a holder and a lid.

* * * * *

UNITED STATES PATENT AND TRADEMARK OFFICE

CERTIFICATE OF CORRECTION

PATENT NO. : 6,444,910 B1
DATED : September 3, 2002
INVENTOR(S) : H. Goto

It is certified that error appears in the above-identified patent and that said Letters Patent is hereby corrected as shown below:

Column 9,
Line 55, "claim 4" should be -- claim 3 --.

Signed and Sealed this

First Day of July, 2003

JAMES E. ROGAN
*Director of the United States Patent and Trademark Office*